US005746128A

United States Patent [19]

Reichwein

[11] Patent Number: 5,746,128

[45] Date of Patent: May 5, 1998

[54] PRINTING CYLINDER SPRAY SHIELD

[75] Inventor: David P. Reichwein, Elizabethtown, Pa.

[73] Assignee: Armstrong World Industries, Inc., Lancaster, Pa.

[21] Appl. No.: 867,032

[22] Filed: Jun. 2, 1997

[51] Int. Cl.[6] ..... B41F 35/00

[52] U.S. Cl. ..... 101/416.1; 101/212; 118/DIG. 15; 492/47

[58] Field of Search ..... 101/416.1, 212, 101/216, 366, 363, 350.1; 118/DIG. 15, 504; 492/18, 47

[56] References Cited

U.S. PATENT DOCUMENTS 2,014,303 9/1935 Weiss ..... 101/366
4,079,672 3/1978 Gasser et al. ..... 101/212
4,966,076 10/1990 John ..... 101/212
5,435,038 7/1995 Sauers ..... 492/47
5,691,018 11/1997 Kelley et al. ..... 118/504

*Primary Examiner*—Edgar S. Burr
*Assistant Examiner*—Anthony H. Nguyen

[57] ABSTRACT

The apparatus is a spray shield to prevent ink and cleaning fluids from being spun off of the ends of printing cylinders. A cylindrical shield around the end of the printing cylinder is attached to a hub resting on the printing cylinder axle, and the hub and shield have sections held together by a hinge and a latch so they can be unlatched and removed for cleaning. An axial spring assembly is attached to the hub on the side opposite from the cylindrical shield so that the springs compress and friction is minimized if the hub is contacted by the printing cylinder.

8 Claims, 2 Drawing Sheets

10
22
16
18
19
12
14
36
38
27
30
31
26
32
56
54
29
25
42
19
50
46
44
52
48
34
12
40
24

PRINTING CYLINDER SPRAY SHIELD

BACKGROUND OF THE INVENTION

This invention deals generally with printing cylinders, and more specifically with a spray shield for the end of the cylinder to prevent ink and cleaning fluids from being thrown from the rotating cylinder by centrifugal force.

Most conventional high speed printing presses use a rotating cylinder to print on a moving sheet which travels through the press. This basic arrangement is used whether the press is printing newspapers or the patterns on flooring material. Furthermore, each color printed requires an individual printing station and a separate printing cylinder. In the flooring industry there can be as many as nine printing stations and cylinders through which continuous sheets of flooring are run.

A long standing problem with printing cylinders which rotate at high speeds is that ink accumulates at the ends of the cylinders where it is not wiped off by the squeegee which acts against the active printing area of the cylinder. This ink on the end of the cylinder then tends to be thrown off the cylinder as spray when the cylinder rotates at full speed. The situation is even worse when the cylinders are being cleaned since the cleaning fluids are less viscous than the inks and therefore are more easily thrown off of the cylinder. Furthermore, the cleaning fluids are frequently volatile or toxic materials so that there is a real danger to personnel when these fluids are sprayed into the environment.

Although the problem of ink and cleaning fluid spraying off the ends of cylinders is limited significantly when the entire press is completely enclosed, even then the spray coats the inside of the walls of enclosure. Furthermore, it is impractical to enclose the largest printing stations, those used to print flooring, so that in such large machines, which are also the ones with the greatest ink capacities, the centrifugal spray has always been present.

SUMMARY OF THE INVENTION

The present invention eliminates the problem of ink and cleaning fluid spraying off the end of printing cylinders by furnishing a spray shield which can be installed upon any existing cylinder without any modification to the press and without first removing the printing cylinder.

The preferred embodiment of the invention is a shield constructed of ultra high molecular weight polyethylene which does not react with most materials, and is particularly passive with inks and cleaning fluids. Furthermore, this polyethylene has a very low coefficient of friction so that any contact it has with the end of the printing cylinder has no effect on the cylinder or the shield. The high density and the inherent "slippery" characteristic of the polyethylene also makes it very easy to clean ink from the shield.

The basic shield is formed with a collar which hangs upon the axle of the printing cylinder and supports a hub which includes a thin outer shield cylinder which extends back over the printing cylinder as far as is needed to shield the portion of the cylinder which accumulates ink and cleaning fluids. The polyethylene material of the hub allows the hub to be stationary and the axle of the printing cylinder to rotate within the hub which is prevented from rotating by contact with other stationary portions of the press.

The shield also has two other special features to add to its utility. One is that the shield is actually constructed as upper and lower halves held together by a hinge and clasp. This permits the shield to be opened up, slipped around the cylinder axle, and then closed and latched, thus permitting the shield to be installed and removed for cleaning and replacement without moving the printing cylinder.

The second feature is the division of the shield into two axial sections along the axis of the hole through which the printing cylinder axle fits. Since the shield essentially occupies all the exposed space between the printing cylinder and the portion of the press which supports the printing cylinder axle, the shield is required to fit into a relatively tight space. The separation of the shield into two separate sections along the axis of the printing cylinder axle permits the shield to fit into the tight space because the two axial sections are attached to each other by the use of several compression springs. Thus, when the outer shield section which is more remote from the printing cylinder is attached to the press frame, the inner section which is closer to the printing cylinder can be pushed toward the printing cylinder. This structure minimizes the exposed surface of the axle without requiring tight tolerances on the spray shield because it causes the inner section to compress the springs when the end of the printing cylinder touches the face of the hub. The compression of the springs therefore minimizes the friction and the wear on the end of the printing cylinder and the face of the hub of the shield even when the dimensions cause interference.

The shield is therefore essentially constructed of four separate sections. There are actually inner and outer upper sections and inner and outer lower sections, but when the upper and lower sections are installed and latched together, only the inner and outer sections function separately during operation of the press.

The shield of the invention thus furnishes a spray shield for the ends of printing cylinders which not only prevents ink and cleaning fluids from being spun out into the environment around the printing press, but which is also easy to install and clean up.

DETAILED DESCRIPTION OF THE INVENTION

Figure 1:
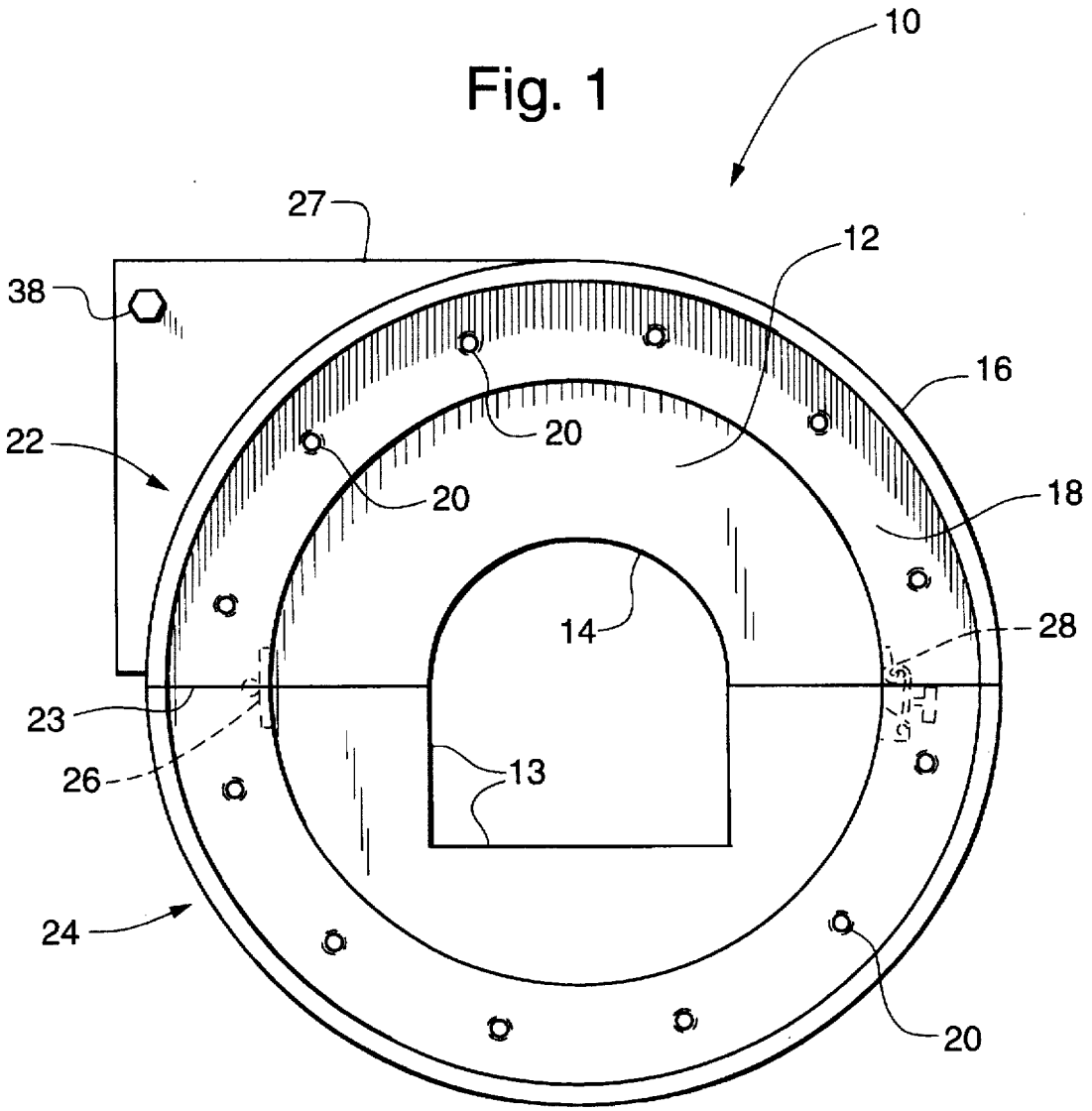
FIG. 1 is a view of the spray shield of the invention as seen from the side of the shield normally installed against the printing cylinder.

FIG. 1 is a view of spray shield 10 of the invention as seen from the inner side of the shield, the side normally installed against the printing cylinder. In FIG. 1, spray shield 10 can be seen to include hub 12 which is shaped on one surface to form collar 14. Hub 12 also supports outer shield cylinder 16 which is formed as one piece with wear strip 18 which is attached to hub 12 by bolts 19 (FIG. 2) located in holes 20 around wear strip 18. Since wear strip 18 is the part of spray shield 10 nearest to the end of the printing cylinder, it is the part which contacts the spinning end of the printing cylinder when such contact occurs.

Spray shield 10 is actually formed of upper section 22 and lower section 24 in contact at dividing surface 23. Sections 22 and 24 together are located around printing cylinder axle 25 (FIG. 2) on top of which collar 14 rests. Upper section 22 and lower section 24 are hinged together at hinge 26 which is shown with dashed lines because it is behind hub 12. Latch 28, also shown with dashed lines, is located diametrically opposite hinge 26. The combination of hinge 26 and latch 28 permits spray shield 10 to be opened up to be installed around printing cylinder axle 25. The hinge arrangement also makes cleaning of spray shield 10 very easy since it can easily be removed and cleaned while off the printing press.

Lower section 24 has essentially the same structure as upper section 22 except that collar 14 need not be duplicated. Since collar 14 contacts the upper surface of printing cylinder axle 25 (FIG. 2) to essentially hang spray shield 10 in place, lower section 24 requires only that lower inner surfaces 13 of hub 12 clear axle 25 which is contacted by collar 14 of upper section 22.

Spray shield 10 can also be constructed to include back shield 27 to intercept spray thrown back along the axis of the printing cylinder. Back shield 27 can be made in virtually any shape and size because, as shown in FIG. 2, it is simply attached to outer surface 29, the surface of spray shield most distant from the printing cylinder, by bolting it into slots within back support block 30 with bolts 31.

Figure 2:
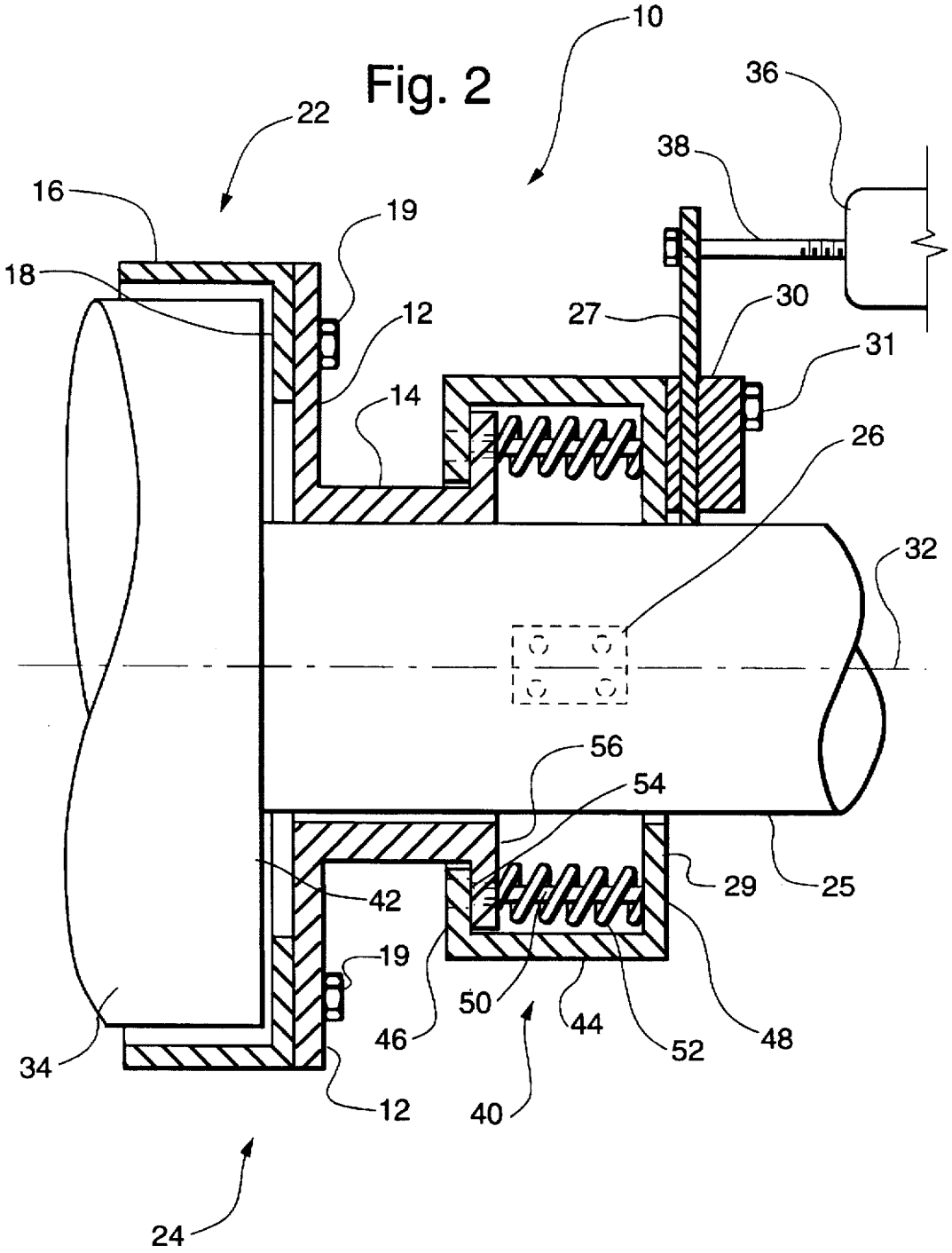
FIG. 2 is a partial cross section view of the spray shield of the invention as seen from the side parallel to the axis of the printing cylinder.

FIG. 2 is a cross section view of spray shield 10 of the invention as seen from the side parallel to axis 32 of printing cylinder 34 and axle 25. FIG. 2 shows that outer shield cylinder 16 extends axially along the outer surface of printing cylinder 34 to shield as much of printing cylinder 34 as is required to prevent ink and cleaning fluid spray from being dispersed into the surrounding environment. Also shown is the contact between collar 14 and axle 25 by which spray shield 10 is located relative to printing cylinder 34. Spray shield 10 can be anchored and prevented from rotating with axle 25 by any attachment to a stationary portion 36 of the printing press, such as using bolt 38 through back shield 27.

FIG. 2 also shows spring housing 40 which adjusts the contact between printing cylinder end surface 42 and wear strip 18 to minimize wear. Spring housing 40 is constructed of cylinder 44 with two flanges, inner flange 46 and outer flange 48, projecting toward axis 32. Several spring rods 50 are located between inner flange 46 and outer flange 48 and are spaced around the flanges, and springs 52 are located around each spring rod. Spring rods 50 also penetrate clearance holes 54 within tail piece 56 which is an integral part of hub 12.

With such a structure any contact of printing cylinder end surface 42 with wear strip 18 moves tail piece 56 along spring rods 50 and compresses springs 52, which minimizes the wear at wear strip 18 and printing cylinder end surface 42.

The spray shield of the invention therefore not only prevents ink and cleaning fluids from being thrown from the printing cylinder into the surrounding environment, but also provides a simple means for installing and removing the spray shield, and even accommodates to variations in the axial lengths or locations of printing cylinders on the same press.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, hub 12 and wear strip 18 could be formed as one piece, or different spring arrangements could be used to provide the movement between the inner and outer sections. Furthermore, hinge 26 could be replaced by a second latch such as latch 28, or both hinge 26 and latch 28 could be replaced by some other disconnecting means.

What is claimed as new and for which Letters Patent of the United States are desired to be secured is:

1. A spray shield for a printing cylinder comprising:

a hub located in a plane transverse to an axle of a printing cylinder and divided into at least two separate interconnected sections;

a collar attached to at least one section of the hub and supporting the hub in a location adjacent to an end of the printing cylinder, with the collar able to fit upon the axle of the printing cylinder;

a shield cylinder divided into at least two sections and attached to the sections of the hub, with the shield cylinder extending from the hub so that it is located around an end portion of the printing cylinder cylindrical surface; and disconnecting means interconnecting the separate sections of the hub and the shield cylinder, with the disconnecting means also permitting the hub sections and the shield cylinder sections to be separated sufficiently to remove the hub and shield cylinder from around the printing cylinder and its axle.

2. The spray shield of claim 1 wherein the disconnecting means is a hinge attached to two sections of the hub at a dividing surface and a latch attached to the two sections of the hub at another location along the dividing surface.

3. The spray shield of claim 1 further including a wear strip attached to the hub and located in a plane transverse to the axle of the printing cylinder with the wear strip located so that it is between the hub and the end of the printing cylinder.

4. The spray shield of claim 1 further including a spring housing interconnected with the hub, located on the side of the hub remote from the shield cylinder, and including springs acting so that the hub can move along the axle of the printing cylinder against the action of the springs which force the hub toward the end of the printing cylinder.

5. The spray shield of claim 1 further including a back shield interconnected to the hub and located so that it intercepts spray traveling along the length of the spray shield.

6. The spray shield of claim 1 further including anchor means interconnected with the hub and attached to a stationary portion of a printing press within which the spray shield is installed in order to prevent rotation of the spray shield.

7. The spray shield of claim 1 wherein the hub, collar, and shield cylinder are constructed of ultra high molecular weight polyethylene.

8. The spray shield of claim 3 wherein the wear strip is constructed of ultra high molecular weight polyethylene.

* * * * *